US005092817A

United States Patent [19]

Abe

[11] Patent Number: 5,092,817

[45] Date of Patent: Mar. 3, 1992

[54] COIN DISPENSING APPARATUS

[75] Inventor: Hiroshi Abe, Tokyo, Japan

[73] Assignee: Asahi Seiko Kabushiki Kaisha, Tokyo, Japan

[21] Appl. No.: 652,178

[22] Filed: Feb. 7, 1991

[30] Foreign Application Priority Data

Feb. 13, 1990 [JP] Japan ..... 2-11941[U]

[51] Int. Cl.[5] ..... G07D 1/00

[52] U.S. Cl. ..... 453/57; 221/203

[58] Field of Search ..... 453/30-35, 453/57; 221/182, 203

[56] References Cited

U.S. PATENT DOCUMENTS 3,818,918 6/1974 Nissmo et al. ..... 453/57
3,942,544 3/1976 Breitenstein et al. ..... 453/57 X
4,589,433 5/1986 Abe ..... 221/203 X
5,000,718 3/1991 Abe ..... 453/57

FOREIGN PATENT DOCUMENTS 2359466 2/1978 France ..... 453/57

*Primary Examiner*—F. J. Bartuska
*Attorney, Agent, or Firm*—Nilles & Nilles

[57] ABSTRACT

A coin dispensing apparatus comprising a hopper for holding a supply of coins in bulk, a rotary disc rotatably disposed at one side within the hopper at an angle to the horizontal, a carrier being rotatable in a plane extending at an angle to the rotary disc and a plurality of coin transporting pins and coin agitating pins carried on the carrier and protruded from the surface of the rotary disc through pin receiving holes in the rotary disc. The protruded end of the coin agitating pin is slanted so as to slope toward the periphery portion of the rotary disc.

3 Claims, 2 Drawing Sheets

COIN DISPENSING APPARATUS

BACKGROUND OF THE INVENTION

1. Field of the Invention

The present invention relates to a coin dispensing apparatus for use in coin exchangers, coin operated gaming machines or the like and more particularly to such a coin dispensing apparatus comprising a hopper for holding a supply of coins or tokens in bulk and a rotary disc which is rotated in the hopper to dispense coins one at a time and in predetermined quantities.

2. Description of the Prior Art

Hitherto, such a coin dispensing apparatus is known as disclosed in Japanese Patent Application Publication No. 62-45,588 (U.S. Pat. No. 4,589,433), and generally comprises a hopper for holding a supply of coins in bulk and a rotary disc rotatably disposed at one side within the hopper at an angle to the horizontal. The rotary disc has a central circular stage provided with a plurality of agitating pins, and a plurality of coin transporting pins arranged in a peripheral portion around the central circular stage such as to receive one coin between two sequential transporting pins spaced apart in the peripheral direction of the rotary disc. The coin dispensing apparatus further comprises a delivery guide and an outlet chute which are fixed to a stationary frame at an upper delivery portion. The delivery guide extends from the outlet chute to an upper periphery of the central stage across the peripheral portion of the rotary disc in the upper delivery portion and has a tunnel passage for passing the transporting pin. Thus, when the rotary disc is rotated, a coin is transported from the bottom portion of the hopper to the outlet chute at the upper delivery portion by each of the transporting pins which project from the surface of the rotary disc and pass through the tunnel passage in the delivery guide.

Aforementioned coin dispensing apparatus of prior art has a disadvantage in that the size of the coin agitating pin is limited since a large pin can carry one or more coins so that a coin counting device usually provided at the front of the outlet chute would make a miscount or the inlet of the outlet chute would be jammed with coins.

In order to solving the aforementioned problems, the coin dispensing device may be arranged such that the coin agitating pins can be extruded from the surface of the central circular stage of the rotary disc in a minimum amount in the upper delivery portion and in a maximum amount at a coin picking up position as disclosed in U.S. Pat. No. 3,818,918 issued to Nissmo et al and in also U.S. patent application Ser. No. 358,836 filed on May 30, 1989 by the present applicant. A coin dispensing apparatus according to the U.S. patent application Ser. No. 358,836 comprises a supporting plate having supporting surfaces presenting first and second peripheral bearing means; a hopper for holding a supply of coins in bulk mounted on said support plate; an outlet chute; a rotary disc having a peripheral portion, a central circular stage and a plurality of circumferentially spaced transporting pin receiving holes and coin agitating pin receiving holes around in the peripheral portion and the said central stage, respectively, and mounted on said first peripheral bearing means to rotatably support said disc in said hopper; a coin delivery guide mounted to extend across said peripheral portion of said rotating disc for guiding coins on said peripheral portion to said outlet chute; and a carrier having a plurality of coin transporting pins and coin agitating pins projecting therefrom through said pin receiving holes in said rotary disc, and a radially outer peripheral area presenting an inner side mounted on said second peripheral bearing means to rotatably support said carrier in said hopper, said carrier being rotatable in a plane extending at an acute angle to said rotary disc so as to cause said pins which extend through said pin receiving holes in said rotary disc to project a minimum amount from said front surface at said delivery guide and to project a maximum amount at said coin picking up position.

However, it has been founded from the result of various tests that the problems of miscounting and jamming of coins in the upper delivery portion by the coin agitating pins can not be satisfactly removed unless amount of extruding of the coin agitating pins in the upper delivery portion is decreased to substantially zero. Moreover, in such an arrangement that the amount of extruding of the coin agitating pins in the upper delivery portion is substantially zero, coins are not effectively agitated by only the coin agitating pins in the bottom portion of the hopper.

SUMMARY OF THE INVENTION

An object of the present invention is to improve the coin dispensing apparatus of U.S. patent application Ser. No. 358,836 so as to remove the aforementioned problems without decreasing the amount of extruding of the coin agitating pins to zero at the upper delivery portion.

According to the present invention, in a coin dispensing apparatus comprising a supporting plate having supporting surface presenting first peripheral bearing means; a hopper connected to the supporting plate for holding a supply of coins in bulk; an outlet chute for discharging coins; a rotary disc having a peripheral portion, a central circular stage and a plurality of circumferentially spaced transporting pin receiving holes and coin agitating pin receiving holes in the peripheral portion and the central stage, respectively, and mounted on said first peripheral bearing means to rotatably support said disc in said hopper; a coin delivery guide mounted to extend across said peripheral portion of said rotating disc for guiding coins on said peripheral portion to said outlet chute; and a carrier having a plurality of coin transporting pins and coin agitating pins projecting therefrom through said pin receiving holes in said rotary disc, and a carrier supporting surface presenting second peripheral bearing means to rotatably support said carrier in said hopper, said carrier being rotatable in a plane extending at an acute angle to said rotary disc so as to cause said pins which extend through said pin receiving holes in said rotary disc to project a minimum amount from said front surface at an upper delivery position and to project a maximum amount at a lower coin picking up position; each the coin agitating pin has a slanted end which is sloped toward the peripheral portion of the rotary disc.

According to the present invention, the end of the coin agitating pin protruding from the surface of the central stage at an upper delivery portion of the hopper is slanted to be sloped toward the peripheral portion of the rotary disc. Therefore, the coin can not be carried by the slanted end of the coin agitating pin at the upper delivery portion so that the discharged coin counting switch is not actuated and also the upper delivery portion of the hopper or the inlet portion of the outlet chute is not jammed by a coin carried on the protruded end of the coin agitating pin at the upper delivery portion, while the length of the coin agitating pin can be made sufficiently long to efficiently agitate coins in the hopper.

The invention will be described in detail by referring to accompanying drawings.

DESCRIPTION OF THE PREFERRED EMBODIMENTS

Figure 1:
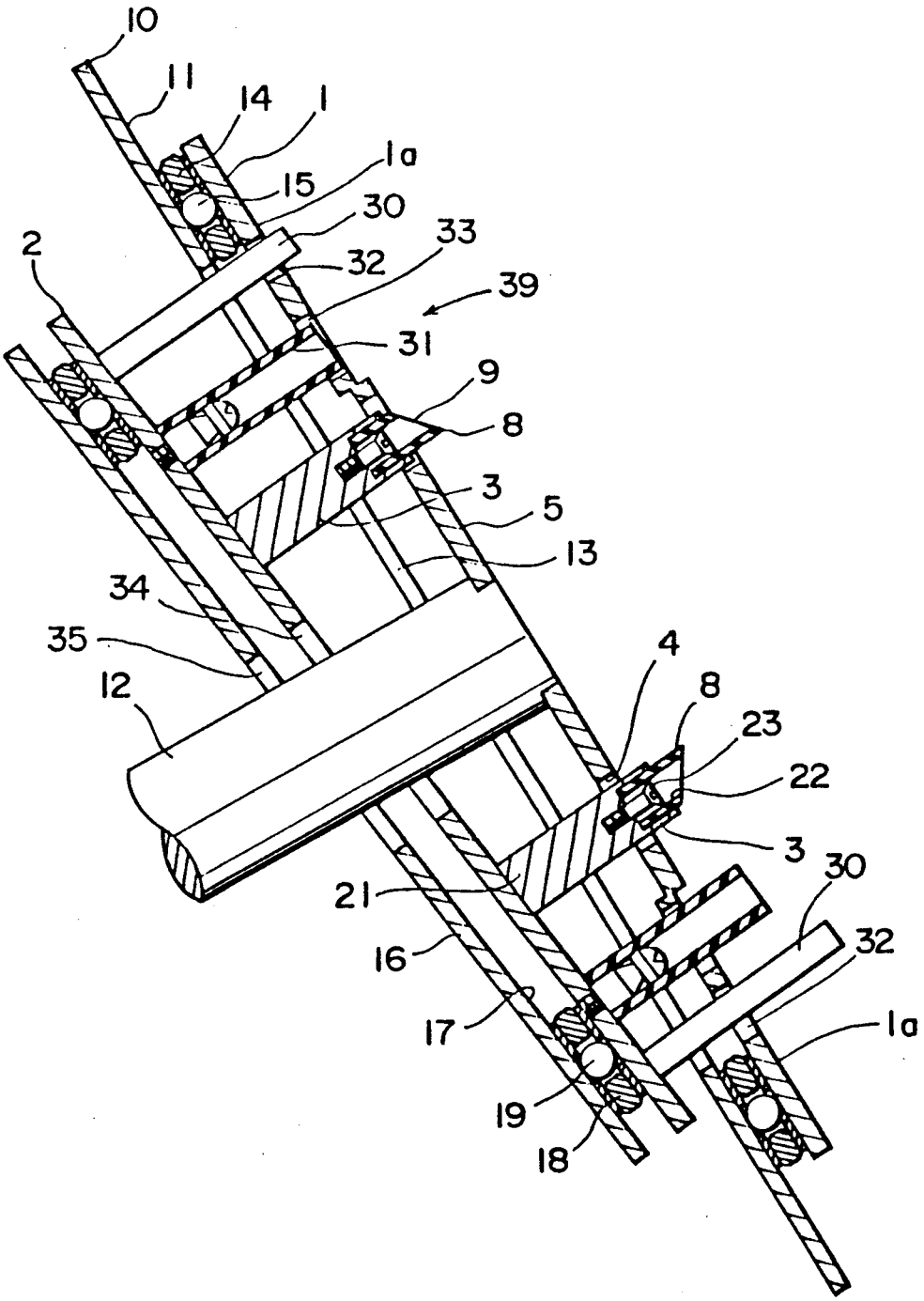
FIG. 1 is a sectional view illustrating an embodiment of a rotary disc used in a coin dispensing apparatus according to the invention.
Figure 2:
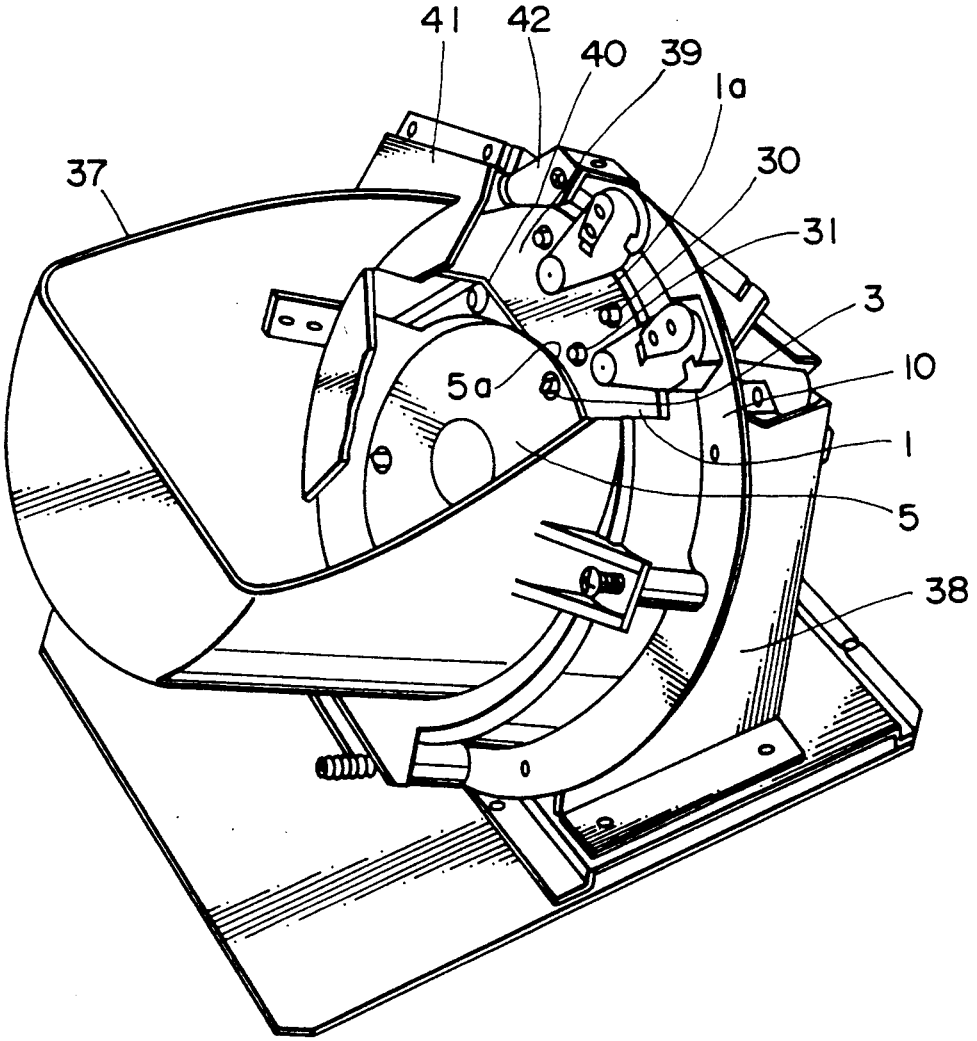
FIG. 2 is a perspective schematic view of a coin dispensing apparatus according to the present invention.

FIGS. 1 and 2 illustrate an embodiment of the coin dispensing apparatus according to the present invention. Referring to FIG. 1, a rotary disc 1 is rotatably supported on a stationary supporting plate 10 which is mounted on a conventional supporting stand as will be mentioned in detail later on.

The rotary disc 1 is drivingly connected to a drive shaft 12 which is extended through a central hole 13 in the stationary supporting plate 10 and is driven by means of a motor (not shown). The rotary disc 1 is rotatably supported on a rotary disc supporting surface 11 of the stationary supporting plate 10 by means of a plurality of rotary disc supporting balls 15 which are spaced from each other in the circumferential direction and rotatably retained by means of a retainer ring 14.

A carrier 2 is also rotatably supported on a carrier supporting surface 17 of a carrier supporting plate 16 by means of a plurality of carrier supporting balls 19 which are also spaced from each other in the circumferential direction and rotatably retained by means of a retainer ring 18. The carrier 2 is connected to the rotary disc 1 by means of flexible shafts 31 made of synthetic resin so as to be rotated together with the rotary disc 1. Each of the flexible shafts 31 is fixed at one end thereof to the carrier 2 and slidably extended through a guide hole 33 formed in the rotary disc 1. The drive shaft 12 is also extended through central holes 34 and 35 in the carrier 2 and the carrier supporting plate 10, respectively.

The carrier supporting plate 16 may be integrally connected to the stationary supporting plate 10 by connecting means (not shown) in a position inclined at an acute angle to the stationary supporting plate 10.

The carrier 2 is provided with a plurality of coin transporting pins 30 and a plurality of coin agitating pins 3 which pins 3 and 30 are spaced apart in the circumferential direction. The coin transporting pins 30 are protruded from the surface of the carrier 2 toward the rotary disc 1 and slidably extended through transporting pin receiving holes 32 which are formed in a peripheral portion 1*a* of the rotary disc 1 and spaced apart by the same circumferential distance as that of the coin transporting pins 30. The coin agitating pins 3 are also protruded from the surface of the carrier 2 toward the rotary disc 1 and slidably extended through agitating pin receiving holes 4 which are formed in a central circular stage 5 of the rotary disc 1 and spaced apart by the same circumferential distance as that of the coin agitating pin 3.

The coin agitating pin 3 has a slanted end 8 which is sloped toward the peripheral portion 1*a* of the rotary disc 1. In the embodiment shown in FIG. 1, the coin agitating pin 3 includes a metallic body 21 which is fixed at the lower end thereof to the carrier 2 by means of a thread or the like and a tip member 8 having a slanted face 9 of rubber or synthetic resin tube which is inserted in a central bore 22 at the upper end of the metallic body 21 and fixed to the upper end such that the slanted face 9 of the tip member 8 slopes toward the peripheral portion 1*a* of the rotary disc 1.

Referring to FIG. 2, the rotary disc 1 is rotatably disposed at one side within a hopper 37 which is connected to the stationary supporting plate 10. This stationary supporting plate 10 is rigidly connected to a supporting stand 38 in a position inclined at an angle to the horizontal. In an upper delivery portion 39, a delivery guide 40, an outlet chute 41 and a discharge coin counter 42 are arranged. The delivery guide 40 extends from the outlet chute 41 to an upper periphery of the central circular stage 5 across the peripheral portion 1*a* of the rotary disc 1 in the upper delivery portion 39 and has a tunnel passage for passing the transporting pin.

In operation, when the rotary disc 1 is rotated by the rotating shaft 12, the carrier 2 is integrally rotated with the rotary disc 1, but in an inclined position in respect to the rotary disc 1. Accordingly, the coin transporting pins 30 and coin agitating pins 3 extend from the surface of the rotary disc 1 into the bottom portion of the hopper 37 in a maximum protrusion amount at a coin picking up position, while the protrusion amount of the coin transporting pins and the coin agitating pins subsequently decreases to a minimum protrusion amount at the upper delivery portion 39. Moreover, at the upper delivery portion, coins slip down along the slanted face 9 of the slanted end 8 protruding from the surface of the central circular stage so that coins can not be carried by the protruded agitating pins 3.

According to the present invention, it is able to effect a high picking up and agitating efficiency by the coin transporting pin 30 and the coin agitating pins 3, without miscounting and jamming of coins at the upper delivery portion, so that the coin dispensing efficiency and the reliability in the operation of the coin dispensing apparatus are remarkably improved.

What is claimed is:

1. A coin dispensing apparatus comprising a supporting plate having supporting surface presenting first peripheral bearing means; a hopper connected to the supporting plate for holding a supply of coins in bulk; an outlet chute for discharging coins; a rotary disc having a peripheral portion, a central circular stage and a plurality of circumferentially spaced transporting pin receiving holes and coin agitating pin receiving holes in the peripheral portion and the central stage, respectively, and mounted on said first peripheral bearing means to rotatably support said disc in said hopper; a coin delivery guide mounted to extend across said peripheral portion of said rotary disc for guiding coins on said peripheral portion to said outlet chute; a carrier having a plurality of coin transporting pins, coin agitating pins projecting therefrom through said pin receiving holes in said rotary disc, and a carrier supporting surface presenting second peripheral bearing means to rotatably support said carrier in said hopper, said carrier being rotatable in a plane extending at an acute angle to said rotary disc so as to cause said pins which extend through said pin receiving holes in said rotary disc to project a minimum amount from said front surface at an upper delivery position and to project a maximum amount at said coin picking up position; each of the coin agitating pins having a slanted end sloping toward the peripheral portion of the rotary disc.

2. The apparatus claimed in claim 1, wherein each of the coin agitating pins includes a metallic body fixed at the lower end thereof to the carrier and a tip member having a slanted face of synthetic resin or the like fixed to the upper end of the metallic body such that the slanted face of the tip member slopes toward the peripheral portion of the rotary disc.

3. The apparatus claimed in claim 1, wherein said carrier is connected to the rotary disc by means of flexible shafts made of synthetic resin so as to be rotated together with the rotary disc, and the flexible shafts are fixed at lower ends thereof to the carrier at positions spaced apart in the circumferential direction and slidably extended through guide holes in the rotary disc.

* * * * *